242-150 SR
10/22/85 OR 4,548,369

United States Patent [19]
Bossart

[11] Patent Number: 4,548,369
[45] Date of Patent: Oct. 22, 1985

[54] THREAD TENSIONING APPARATUS FOR WARP CREEL

[75] Inventor: Erwin Bossart, Flawil, Switzerland

[73] Assignee: Maschinenfabrik Benninger AG, Uzwil, Switzerland

[21] Appl. No.: 725,637

[22] Filed: Apr. 22, 1985

[30] Foreign Application Priority Data

May 3, 1984 [CH] Switzerland ..... 2153/84

[51] Int. Cl.[4] ..... B65H 59/22
[52] U.S. Cl. ..... 242/150 R; 242/131
[58] Field of Search ..... 242/105 R, 150 M, 149, 242/147 R, 129.8, 131, 131.1

[56] References Cited

U.S. PATENT DOCUMENTS

| | | | |
|---|---|---|---|
| 2,646,943 | 7/1953 | Lindsay | 242/150 R |
| 2,912,185 | 11/1959 | Vossen | 242/150 R |
| 3,459,389 | 8/1969 | Wildi et al. | 242/150 R |
| 4,175,718 | 11/1979 | Derichs et al. | 242/150 R |
| 4,202,511 | 5/1980 | Koslowski | 242/150 R |
| 4,272,038 | 6/1981 | Wildi | 242/150 R |

*Primary Examiner*—Stanley N. Gilreath
*Attorney, Agent, or Firm*—Werner W. Kleeman

[57] ABSTRACT

A thread withdrawn from a bobbin is passed along a straight line through a plate brake. A base brake plate is driven by a drive extending outside the periphery of the base brake plate. A tensioning device removably attached to a top brake plate is connected therewith by a ball snap-type connection. It comprises a first compression spring with one end supported at a gripping sleeve and slideable along a pressing pin surrounded by this compression spring. The gripping sleeve is connected to a displaceable control plate extending parallel to the pressing pin. This control plate permits a simultaneous variation and adjustment of the pressure exerted by a number of such similar tensioning devices. A second compression spring surrounding the pressing pin is supported at a side of the gripping sleeve remote from the first compression spring and counteracts the first compression spring, so that the difference of the spring forces acts upon the top brake plate. This difference can be continuously adjusted from a negative value through zero to a positive valve by displacing the control plate, and thus, the position of each gripping sleeve relative to the pressing pin.

14 Claims, 1 Drawing Figure

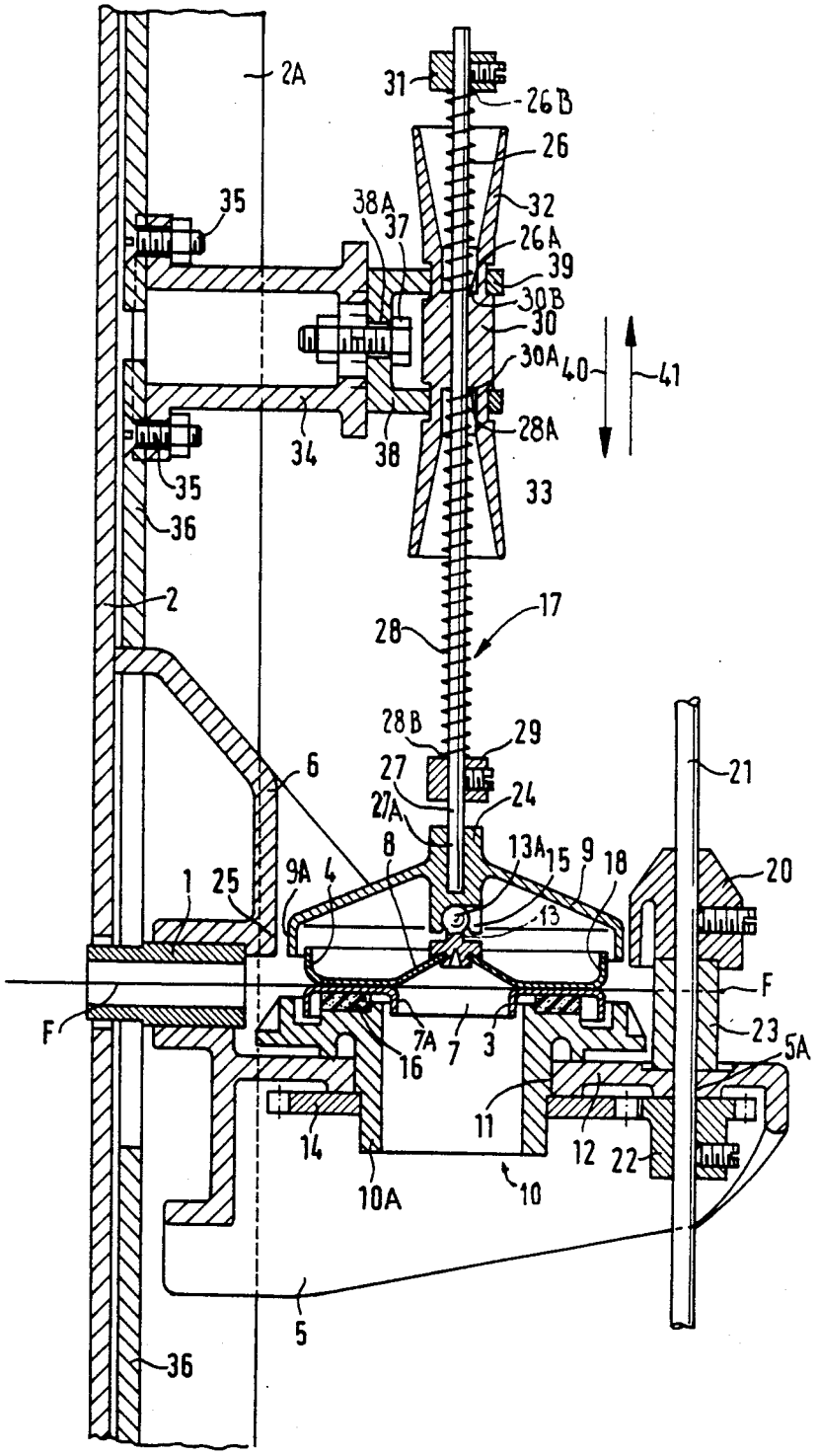
2A
31
26B
26
32
35
38A
37
26A
39
30B
30
30A
40
41
28A
34
38
33
35
36
2
17
28
28B
29
27
24
27A
21
6
8
13A
15
9
18
20
1
25
9A
4
13
F
F
23
5A
7A
7
3
16
11
14
12
22
10A
10
5
36

THREAD TENSIONING APPARATUS FOR WARP CREEL

BACKGROUND OF THE INVENTION

The present invention relates to a new and improved construction of a thread tensioning apparatus for use with a warp creel, especially in warp and beam warping installations. The present invention also relates to a warp creel, especially in warp and beam warping installations, and which is equipped with the new and improved construction of the thread tensioning apparatus.

In its more particular aspects the present invention specifically relates to a new and improved tensioning apparatus for use in a warp creel, especially in warp and beam warping installations, and which contains a pair of brake plates, one of which is mounted for rotation and in an axially stationary manner. An other one of the brake plates is peripherally centered at the rotationally driven brake plate. The other brake plate can be pressed against the rotationally driven brake plate with a variable and adjustable pressure by means of a tensioning device which acts upon the center of the other brake plate. The tensioning device comprises a compression spring, one end of which is supported at a gripping sleeve which is slideable along a pressing pin surrounded by the compression spring. The gripping sleeve is operatively connected to a displaceable control plate which extends parallel to the pressing pin and by means of which there can be simultaneously varied the pressure applied by a predetermined number of such similar tensioning devices.

A thread tensioning apparatus of the type as described hereinbefore is known, for example, from Swiss Pat. No. 636,653 and permits, in addition to a total displacement of all tensioning devices of a creel by displacing the control plate, an individual adjustment of each individual tensioning device in order to compensate for differences in the tension of the individual threads. Such differences in the thread tensions may be due to different thread runs between bobbins or spools which are placed at a starting position and at an end position of the creel, between bobbins or spools in horizontal and vertical rows and others. The known tensioning device is very easily serviceable because it can be mounted and dismounted by means of a few manual manipulations. Particularly, the entire tensioning device can be removed and re-mounted without any tools since the gripping sleeve is chucked by means of a clamping piece or member.

It is, however, a disadvantage of this known thread tensioning apparatus that even when the compression spring is totally relieved and when the control plate is displaced through its maximum displacement, the thread which is drawn between the two brake plates is still braked due to the inherent weight of the tensioning device and that of the other or top brake plate. In order to diminish this disadvantage and also in order to operate at the smallest possible thread tensions, it is required in the known thread tensioning apparatus to design the other or top brake plates and the members which act thereupon, even in the totally relieved state of the thread tensioning apparatus due to their inherent weight, with the lowest possible weight. It will be understod that there is thus impaired the strength and the service life of such members and that also greater expenses are caused thereby.

For this reason there are known quite a number of thread tensioning apparatuses which permit by-passing a force accumulator which generates the basic tension, by employing measures which counteract the force accumulator in order to thereby enable a completely tension-free passage of the thread between the two brake plates.

In a thread brake as known, for example, from Swiss Pat. No. 577,571 or German Gebrauchsmuster No. 7,400,404, the other or top brake plate is loaded by means of a spring or by means of weights and can be lifted off from the one or base brake plate by means of a ram which extends through a gap in the one or base brake plate and acts upon the other or top brake plate. The stroke of the ram required therefore is generated by means of an eccentric disc.

In a similar arrangement as known, for example, from German Pat. No. 597,635, German Pat. No. 975,270 as well as U.S. Pat. No. 2,912,185, the pressure generated by a helical spring is gradually reduced by means of a lever linkage. In a thread tensioning apparatus as known, for example, from Swiss Pat. No. 559,143, the spring relief is pneumatically effected.

The thread tensioning apparatuses as known from the last-mentioned printed publications have the common disadvantage that the clamping region between the brake plates is traversed by members of the loading and relieving means, whereby dirt and contaminant accumulations and undesired friction locations are formed. The removal of dirt or contaminants as well as the threading-in of the thread or the like is thereby rendered more difficult. In all these known thread tensioning apparatuses the loading means and the relieving means are arranged on opposite sides of the pair of brake plates. The load or relief is effected by different means such as, for example, a weight and a spring, a spring and a pneumatically operated membrane, a spring and a linkage, and thereby any fine tuning, if possible at all, is considerably impeded.

In a plate brake mechanism for wire spooling frames as known, for example, from European Patent Publication No. 11,826, the brake plates are each arranged at an end of a related hinged arm. The pressing power can be regulated by means of a compression spring which compresses the hinged arms. A second weaker compression spring acts upon the two hinged arms in such a manner as to urge the hinged arms away from each other. This second compression spring serves as a relief spring. This relief spring cannot be regulated and serves the single purpose of compensating for the masses which have to be moved. The relief spring is not at all suited for the regulation of very fine thread tensions. The entire mechanism, due to its weight and structural size or volume, is unsuited for use in combination with a warp creel.

SUMMARY OF THE INVENTION

Therefore, with the foregoing in mind it is a primary object of the present invention to provide a new and improved construction of a thread tensioning apparatus for use in a warp creel, especially in warp and beam warping installations, and which permits, if desired, total relief of the other or top brake plate and even a lift-off thereof from the one or base brake plate in order to enable using the same tensioning device for very fine threads as well as for coarse threads, while maintaining all the advantages of the initially mentioned known thread tensioning apparatuses, particularly the tool-less mounting and dismounting of the unit tensioning device.

Another significant object of the present invention is directed to a new and improved construction of a thread tensioning apparatus for use in a warp creel, especially in warp and beam warping installations, and which permits the retrofitting of already existent thread tensioning apparatuses.

Now in order to implement these and still further objects of the invention, which will become more readily apparent as the description proceeds, the thread tensioning apparatus of the present development is manifested by the features that, the tensioning device comprises a second compression spring which surrounds the pressing pin and which is supported at the gripping sleeve on a side thereof which is opposite to the first compression spring. This second compression spring counteracts the first compression spring, so that the other or top brake plate is subjected to the difference of the spring forces generated by the two compression springs. This difference of the spring forces can be continuously adjusted from a negative value through zero to a positive value by displacing the control plate and thus the position of the gripping sleeve relative to the pressing pin.

Depending upon the displacement of the control plate and the position of the gripping sleeve at the pressing pin produced by such displacement, there is simultaneously produced, on the one hand, a greater compression of the loading spring and a greater relief of the relief spring, whereby the other or top brake plate is subjected to an increasing pressure against the one or base brake plate. Depending upon the displacement of the control plate and the position of the gripping sleeve at the pressing pin produced by such displacement, there is simultaneously produced, on the other hand, a greater compression of the relief spring and a greater relief of the loading spring, whereby after passage through a zero-position in which the spring forces balance each other, the other or top brake plate can be lifted off from the one or base brake plate.

Complications between the force and the counterforce are avoided with the inventive thread tensioning apparatus by relieving as well as loading the other or top brake plate by means of related compression springs and by providing compression springs with superposed spring characteristics.

The spring characteristics of the two compression springs can be selected such that great displacements of the control plate result in small pressure changes at the other or top brake plate, whereby more uniform thread tensions throughout all the operatively associated tensioning devices of the warp creel are more easily obtained.

In the inventive thread tensioning apparatus the load or loading spring as well as the relief spring act upon the same brake plate on the same side thereof. According to a specifically advantageous embodiment of the inventive thread tensioning apparatus, the tensioning device may form a structural unit which can be attached to or removed from a resilient clamping piece or member by means of the gripping sleeve. This structural unit can be attached to or removed from the one or base brake plate by means of a ball snap-type connection or lock without the use of a tool.

In this manner the tensioning device not only can be removed or re-attached in a single manipulation, but also after such a simple dismounting of the tensioning device the other or top brake plate is accessible and which top brake plate loosely bears upon the one or base brake plate. The other or top brake plate can then be lifted off, for example, for the purpose of removing contaminants or for dismounting the one or base brake plate.

In accordance with a further development of the inventive thread tensioning apparatus the gripping sleeve is provided at both its ends with related funnel-shaped extensions surounding a related one of the two compression springs. Such extensions protect the compression springs which surround the pressing pin or shaft during the aforementioned mounting and dismounting manipulations.

In a further preferred embodiment of the inventive thread tensioning apparatus a socket of the ball snap-type connection or lock is arranged at a substantially conical cap or cover into which the end of the pressing pin is inserted, this end being located at the side of the brake plate. The cover or cap covers and centers the other or top brake plate which centrally supports a ball of the ball snap-type connection or lock and which loosely bears upon the one or base brake plate. Such cap or cover prevents contamination of the brake plates from above because any contaminants can slide-off the inclined surfaces of such cap or cover.

BRIEF DESCRIPTION OF THE DRAWING

The invention will be better understood and objects other than those set forth above, will become apparent when consideration is given to the following detailed description thereof. Such description makes reference to the annexed single FIGURE of the drawing which shows a vertical section through part of a vertically extending profiled rail of a warp creel and through part of an exemplary embodiment of the inventive thread tensioning apparatus arranged at such warp creel.

DETAILED DESCRIPTION OF THE PREFERRED EMBODIMENTS

Describing now the drawings, it is to be understood that only enough of the construction of the thread tensioning apparatus has been shown as needed for those skilled in the art to readily understand the underlying principles and concepts of the present development, while simplifying the showing of the drawing. Turning attention now specifically to the single FIGURE of the attached drawing, there has been shown in vertical section part of a profiled rail 2. At the creel frame of the entire warp creel with which the exemplary embodiment of the inventive thread tensioning apparatus is used, there is arranged a multitude of conventional bobbins or spools in known manner in a close arrangement above each other in horizontal floors or decks. The threads F which are withdrawn from each one of the bobbins or spools are passed through related sleeves 1 in the profiled rail 2 which has a substantially U-shape in cross-section and which is located immediately adjacent these bobbins or spools. One such sleeve 1 and one such thread F is shown in the single FIGURE of the drawing. In or at the profiled rail 2 there are mounted all of a predetermined number of adjustable tensioning devices 17 for the threads F of the bobbins or spools which form a vertical row of bobbins or spools in the warp creel. The entirety of the profiled rails 2 which are also called brake rails, forms the brake table or panel of the warp creel.

Each thread F, after exiting from the profiled rail 2 or the related sleeve 1, is passed through a related one of a predetermined number of plate brakes and specifically between the one or base brake plate 3 and the other or top brake plate 4 of each one of the predetermined number of plate brakes. Thereafter, the threads F are deflected by about 90° at related deflecting means described hereinafter in a direction towards a winding drum of a winding machine.

A two-membered support or retainer 5, 6 is provided for holding each one of the predetermined number of plate brakes at the profiled or brake rail 2. The support or retainer 5, 6 is readily removably mounted at the profiled or brake rail 2 and thus can be rapidly and simply dismounted for replacement or cleaning and remounted again in correct position.

In the mounted state of the thread tensioning apparatus an arm 12 of the lower support or retainer 5 extends horizontally and contains a central bore or gap 11. A rotary cage 10 bears loosely and rotatably upon the arm 12. The rotary cage 10 comprises a hub 10A at which a gear 14 is mounted on the opposite side of the arm 12. The gear 14 is appropriately prevented from rotation relative to the rotary cage 10 and simultaneously limits axial displacements of the mounted rotary cage 10. The rotary cage 10 carries a damping ring 16 which may be formed, for example, of foamed or expanded material. The one or base brake plate 3 of the plate brake bears upon the damping ring 16. This base brake plate 3 possesses a central aperture or opening 7 which defines a collar 7A which is downwardly drawn or bent and extends into the opening defined by the rotary cage 10. Dirt or contaminants deposited intermediate the two brake plates 3 and 4 of the plate brake leave this plate brake through the collar 7A of the base brake plate 3. The outer rim portion of the base brake plate 3 is also downwardly drawn or bent and thereby the thread F can be prevented from becoming damaged at projecting edges during passage through the plate brake.

The other or top brake plate 4 of the plate brake peripherally and loosely bears upon the one or base brake plate 3. At its periphery this top brake plate 4 possesses an outer collar 18 which is upwardly drawn or bent. At its center such top brake plate 4 possesses a substantially conical elevation 8, and a ball-carrying member 13 of a ball snap-type connection or lock 13, 15 is inserted into the tip of the elevation 8. A ball 13A is carried by the ball-carrying member 13. A socket 15 of the ball snap-type connection or lock 13, 15 is formed at a substantially conical cap or cover 9 which forms a member of an adjustable tensioning device generally designated by reference character 17. The other or top brake plate 4 is substantially centrally acted upon by the adjustable tensioning device 17 and thereby the pressure can be regulated at which the top brake plate 4 bears upon the base brake plate 3, as will be explained in detail hereinafter.

The ball snap-type connection or lock 13, 15 is structured such that in the snapped-in position of the ball 13A there are enabled relative rotations between the cap or cover 9 and the top brake plate 4 as well as relative tilting movements of these two members to a certain extent. The ball snap-type connection or lock 13, 15 also centers the cap or cover 9 at the top brake plate 4.

This top brake plate 4 is guided by means of an outer rim portion 9A of the cap or cover 9, on the one hand, at the internal surface of a centering segment 25 which is formed at the upper support or retainer 6, and, on the other hand, at the outer surface of a driving cone 20 described in more detail hereinafter in such a manner that the two brake plates 3 and 4 approximately centrally bear upon each other.

On the side which is remote from the plate brake with respect to the profiled or brake rail 2 and outside of the plate brake the lower support or retainer 5 possesses a bore 5A which is traversed by a drive shaft 21. This drive shaft 21 extends parallel to the profiled or brake rail 2 and is rotatably driven by means of a not particularly illustrated drive motor. This drive shaft 21 traverses in the same manner all of the supports or retainers of the thread tensioning apparatus and which are arranged on top of each other at the profiled or brake rail 2, and thus forms a common drive shaft therefor.

In the region of each tensioning device 17 a drive pinion 22 is fixedly screwed or mounted by any suitable mounting means at the drive shaft 21 in such a manner that the drive pinion 22 is prevented from rotation relative to the drive shaft 21. The drive pinion 22 meshes with the gear 14 which is connected to the rotary cage 10 in such a manner as to be prevented from rotating relative to the rotary cage 10. Consequently, the base brake plate 3 of the plate brake is caused to rotate about its axis 3A via the rotary cage 10 and the damping ring 16 when the drive shaft 21 is rotated.

A deflecting sleeve 23 is slipped upon the drive shaft 21 and is located between the drive pinion 22 and the drive cone 20. The deflecting sleeve 23 has a length dimensioned such that this deflecting sleeve 23 is intersected by the plane of contact defined by the two brake plates 3 and 4. The drive cone 20 follows the deflecting sleeve 23 at the drive shaft 21 and is seated thereupon in such a manner as to be prevented from rotating relative to the drive shaft 22. The length of the deflecting sleeve 23 is dimensioned such that the cylindrical surface of the drive cone 20 is intermittently in frictional driving connection with the rim portion 9A of the cap or cover 9.

The deflecting sleeve 23 is caused to rotate by the thread F conjointly with the drive shaft 21 when the deflecting sleeve 23 is mounted thereat in such a manner as to be prevented from rotating relative to the drive shaft 21 or when the deflecting sleeve 23 is journalled for rotation at the drive shaft 21. Due to such arrangement continuously changing parts of the deflecting sleeve 23 are contacted by the thread F deflected by such deflecting sleeve 23, and thus local wear is prevented to a large extent. Simultaneously the thread contacting surfaces of the deflecting sleeve 23 are automatically cleaned due to the rotation under the action of the thread F. The same is also true for the other or top brake plate 4 which is intermittently caused to rotate due to the friction between the cap or cover 9 and the drive cone 20 by means of its collar 18 as well as by means of the ball snap-type connection or lock 13, 15. Also in this case changing contact surfaces exist with respect to the thread F which is passed intermediate the brake plates 3, 4.

The closed cap or cover 9 covering the other or top brake plate 4 protects this brake plate and the entire thread or plate brake from contamination originating particularly from the identical tensioning devices 17 or brake plates arranged thereabove. Due to its downwardly inclined surface the cap or cover 9 enables sliding-off of dirt particles or the like.

The adjustable tensioning device 17 for regulating the thread tension at the illustrated plate brake, in addition to the cap or cover 9, comprises a pressing pin or shaft 27 having an end 27A which is axially inserted into a hub 24 of the cap or cover 9. The tensioning device 17 thus acts approximately centrally upon the other or top brake plate 4.

A first compression or load spring 28 surrounds the pressing pin or shaft 27. One end 28A of this first compression or load spring 28 is supported at a first support side 30A of a gripping sleeve 30 which is axially displaceable along the pressing pin 27. The other end 28B of the first compression spring 28 is supported at a set ring 29 which is displaceable along the pressing pin 27. The displaceable set ring 29 permits individual adjustment of the first compression spring 28. A second compression or relief spring 26, which also surrounds the pressing pin 27, is supported at one end 26A thereof at a second support side 30B of the gripping sleeve 30 and which is located at the end of the gripping sleeve 30 which is remote from the first compression spring 28. The other end 26B of the second compression spring 26 is supported at a second set ring 31 which is lengthwise displaceable at the free end of the pressing pin 27. The displaceable set ring 31 permits individual adjustment of the second compression spring 26.

As evident from the drawing, the gripping sleeve 30 is provided at both of its ends with substantially funnel-shaped extensions 32 and 33 which respectively extend from the second support side 30B and from the first support side 30A of the gripping sleeve 30 and which protectingly surround the two compression springs 26 and 28 at least at a region closely adjacent to the gripping sleeve 30 in order to protect the two compression springs 26 and 28 during manipulations at the tensioning device 17.

This tensioning device 17 which is composed of the members 9, 15, and 26 to 33 forms a structural unit and is removably attached or chucked between resilient clamping fingers 39 of a clamping piece or member 38 by means of the gripping sleeve 30. The clamping piece or member 38 possesses a slot 38A through which a set screw 37 extends. By means of the slot 38A and the set screw 37 the clamping piece or member 38 can be fixedly positioned in different elevational positions relative to a bracket 34. This bracket 34 is mounted by means of bolts or screws 35 or other suitable mounting means at a displaceable control plate 36 which is guided between the legs of the profiled or brake rail 2. One of the legs 2A is indicated in the single FIGURE of the drawing. The control plate 36 can be displaced between the legs in vertical direction. Related brackets 34 are mounted at the control plate 36 for all of the predetermined number of tensioning devices 17. Consequently and by vertically displacing the control plate 36 and conjointly therewith the gripping sleeves 30, all of the predetermined number of tensioning devices 17 arranged at the profiled or brake rail 2 are simultaneously adjusted by the same amount as will be explained in more detail hereinafter. In this manner there can be simultaneously varied and adjusted the pressure at which the other or top brake plate 4 is pressed against the one or base plate 3 in each one of the predetermined number of plate brakes by means of the predetermined number of tensioning devices 17 which are operatively associated with the control plate 36. The structural unit formed by the tensioning device 17 is removably attached to the other or top brake plate 4 by means of the ball snap-type connection or lock 13, 15.

The adjustability of the clamping piece or member 38 relative to the bracket 34 as well as the adjustability of the two compression springs 26 and 28 by means of the related set rings 29 and 31 enables an individual adjustment of the pressure acting upon the other or top brake plate 4 in each plate brake independently of the total displacement of the control plate 36, in order to balance differences in thread tensions due to different thread runs between the first and the last as well as between the upper and lower bobbins or spools of the warp creel. The other or top brake plate 4 is thus pressed against the one or base brake plate 3 with an adjustable and variable pressure by the tensioning device 17.

It will be readily understandable that the two compression springs 26 and 28 counteract each other in their action upon the pressing pin or shaft 27 which is axially displaceable within the gripping sleeve 30, and in their action via the pressing pin 27 upon the cap or cover 9 and the other or top brake plate 4 which is connected to the cap or cover 9 by means of the ball snap-type connection or lock 13, 15. The pressure exerted upon the top brake plate 4 corresponds to the difference of the spring forces generated by the two compression springs 26 and 28. This difference of the spring forces can be continuously adjusted between a range of negative values of such difference and positive values of such difference through a zero value of such difference by displacing the control plate 36 and conjointly therewith the gripping sleeve 30 relative to the pressing pin 27.

When the control plate 36 and thus the gripping sleeve 30 are displaced in the direction of the arrow 40, the first compression spring 28 is compressed to a greater degree and simultaneously therewith the second compression spring 26 is relieved. The pressure effective between the two brake plates 3 and 4 is thus increased in the same manner as in the initially mentioned thread tensioning apparatus as known from Swiss Pat. No. 636,653.

When the control plate 36 and thus the gripping sleeve 30 are displaced in the opposite direction according to the arrow 41, the first compression spring 28 is relieved. In the absence of the second compression spring 26 and at total relief of the compression spring 28, i.e. at maximum displacement of the control plate 36 in the direction of the arrow 41, the weight of the members 4, 13, 15, 9, 24, 27, 29 and 31 would still act upon the thread F. In the presence of the second compression spring 26 there can now also be eliminated such braking action. When the gripping sleeve 30 is displaced in the direction of the arrow 41 there is not only relieved the first compression spring 28, but simultaneously therewith the second compression spring 26 is more strongly compressed. The force of the second compression spring 26 now exceeds the force of the first compression spring 28 and acts upon the pressing pin 27 via the set ring 31 in the direction of the arrow 41, whereby the weight of the aforementioned members 4, 13, 15, 9, 24, 27, 29 and 31 can be compensated to the degree required and adjusted by the displacement of the control plate 36.

It is thus possible to cover, using one and the same thread tensioning apparatus, a very wide, so-to-speak universal range of thread tensions including a completely tension-free condition for very fine threads. Whereas hitherto a number of warp creels were required for different ranges of thread tension, there can now be generated all of the appearing operating tensions at a single warp creel which is equipped with the inventive thread tensioning apparatuses and thereby the required investments can be reduced. Dead times for conversion in adaptation to different types of threads are practically eliminated because the tension adjustment can be made even during operation.

It is an additional further advantage that in the inventive thread tensioning apparatus the inherent weight of the tensioning device 17 and that of the other or top brake plate 4 is of no significance since these are compensated by the tensioning device 17. These members as well as their design can thus be selected without considering the resulting weight in order to insure high wear resistance and long service life.

It has already been indicated that the tensioning device 17 can be simply and rapidly mounted and dismounted without any tools for replacement, cleaning or repair or in order to make accessible the members of the thread tensioning apparatus which are arranged below the tensioning device 17.

Advantageously, the spring characteristics of the first compression spring 28 and of the second compression spring 26 are selected such that a great displacement or stroke of the control plate 36 only results in small changes of the tension, so that the tension can be very finely regulated for all of the thread tensioning apparatuses. There cannot result in any case complications between the force and the counterforce as in the hitherto known thread tensioning apparatus containing loading and relieving means because the loading or first compression spring 28 and the relief or second compression spring 26 are superposed in correspondence with their spring characteristics.

While there are shown and described present preferred embodiments of the invention, it is to be distinctly understood that the invention is not limited thereto, but may be otherwise variously embodied and practiced within the scope of the following claims.

Accordingly, what I claim is:

1. A thread tensioning apparatus for use in a warp creel, especially in warp and beam warping installations, comprising:

at least one pair of brake plates;

one of said brake plates being mounted for rotation about its axis and in an axially stationary manner;

an other one of said brake plates bearing upon said one brake plate in a peripherally centered manner and being approximately centered relative thereto;

at least one adjustable tensioning device centrally acting upon said other one of said brake plates;

said adjustable tensioning device pressing said other one of said brake plates with a variable and adjustable pressure against said one of said brake plates;

said adjustable tensioning device comprising:

a pressing pin;

a first compression spring surrounding said pressing pin and having one end;

a gripping sleeve slideably mounted at said pressing pin and having a first support side and a second support side remote from said first support side;

said one end of said first compression spring being supported at said first support side of said gripping sleeve;

a second compression spring surrounding said pressing pin and having one end;

said one end of said second compression spring being supported at said gripping sleeve at said second support side thereof;

said second compression spring counteracting said first compression spring such that said other one of said brake plates is subjected to the difference of the spring forces originating from said first compression spring and said second compression spring;

a displaceable control plate extending substantially parallel to said pressing pin;

said gripping sleeve of said at least one adjustable tensioning device being operatively connected to said control plate; and said control plate being displaceable and conjointly therewith said gripping sleeve being displaceable relative to said pressing pin such that said difference of said spring forces is continuously adjustable between a range of negative values of such difference and a range of positive values of such difference through a zero value of such difference.

2. The thread tensioning apparatus as defined in claim 1, further including:

a resilient clamping member operatively associated with said gripping sleeve;

a ball snap-type connection operatively associated with said other one of said brake plates; and said at least one adjustable tensioning device forming a structural unit removably attachable to said resilient clamping member by means of said gripping sleeve and to said other one of said brake plates by means of said ball snap-type connection without requiring the aid of a tool.

3. The thread tensioning apparatus as defined in claim 1, further including:

substantially funnel-shaped extensions provided at said gripping sleeve; and each of said funnel-shaped extensions extending from a related one of said first and second support sides of said gripping sleeve and protectively surrounding a related one of said first and second compression springs.

4. The thread tensioning apparatus as defined in claim 2, further including:

a substantiallay conical cover;

a socket of said ball snap-type connection being aranged at said cover;

said pressing pin defining an end facing said other one of said brake plates;

said end of said pressing pin being inserted into said substantially conically shaped cover;

a ball of said ball-type connection being centrally supported at said one of said brake plates; and said cover covering and centering said other one of said brake plates which loosely bears upon said one of said brake plates.

5. The thread tensioning apparatus as defined in claim 1, further including:

displaceable set rings each of which is operatively associated with a related one of said first compression spring and said second compression spring of said at least one adjustable tensioning device; and each said first compression spring and each said second compression spring being individually adjustable by means of the displaceable set ring operatively associated therewith.

6. The thread tensioning apparatus as defined in claim 1, wherein:

each one of said first compression spring and of said second compression spring possesses a related spring characteristic; and said spring characteristics of said first compression spring and of said second compression spring being selected such that a relatively large displacement of said control plate results in a small change in the pressing force generated by said first compression spring and said second compression spring.

7. The thread tensioning apparatus as defined in claim 1, wherein:

said at least one pair of brake plates constitutes a predetermined number of pairs of brake plates;

said at least one adjustable tensioning device constitutes a predetermined number of adjustable tensioning devices each of which is operatively associated with a related one of said predetermined number of pairs of brake plates;

said displaceable control plate being operatively connected to said predetermined number of adjustable tensioning devices by means of the gripping sleeves thereof; and said control plate being displaceable and conjointly therewith said gripping sleeves being displaceable relative to the pressing pins of said predetermined number of adjustable tensioning devices such that said difference of said spring forces is continuously adjustable between said range of negative values and said range of positive values through said zero value of such difference at all of said predetermined of adjustable tensioning devices with which said control plate is operatively connected.

8. A warp creel, especially in warp and beam warping installations, and containing a thread tensioning apparatus comprising:

at least one pair of brake plates;

one of said brake plates being mounted for rotation about its axis and in an axially stationary manner;

an other one of said brake plates bearing upon said one brake plate in a peripherally centered manner and being approximately centered relative thereto;

at least one adjustable tensioning device centrally acting upon said other one of said brake plates;

said adjustable tensioning device pressing said other one of said brake plates with a variable and adjustable pressure against said one of said brake plates;

said adjustable tensioning device comprising:

a pressing pin;

a first compression spring surrounding said pressing pin and having one end;

a gripping sleeve slideably mounted at said pressing pin and having a first support side and a second support side remote from said first support side;

said one end of said first compression spring being supported at said first support side of said gripping sleeve;

a second compression spring surrounding said pressing pin and having one end;

said one end of said second compression spring being supported at said gripping sleeve at said second support side thereof;

said second compression spring counteracting said first compression spring such that said other one of said brake plates is subjected to the difference of the spring forces originating from said first compression spring and said second compression spring;

a displaceable control plate extending substantially parallel to said pressing pin;

said gripping sleeve of said at least one adjustable tensioning device being operatively connected to said control plate; and said control plate being displaceable and conjointly therewith said gripping sleeve being displaceable relative to said pressing pin such that said difference of said spring forces is continuously adjustable between a range of negative values of such difference and a range of positive values of such difference through a zero value of such difference.

9. The warp creel as defined in claim 8, further including:

a resilient clamping member operatively associated with said gripping sleeve;

a ball snap-type connection operatively associated with said other one of said brake plates; and said at least one adjustable tensioning device forming a structural unit removably attachable to said resilient clamping member by means of said gripping sleeve and to said other one of said brake plates by means of said ball snap-type connection without requiring the aid of a tool.

10. The warp creel as defined in claim 8, further including:

substantially funnel-shaped extensions provided at said gripping sleeve; and each of said funnel-shaped extensions extending from a related one of said first and second support sides of said gripping sleeve and protectively surrounding a related one of said first and second compression springs.

11. The warp creel as defined in claim 9, further including:

a substantially conical cover;

a socket of said ball snap-type connection being arranged at said cover;

said pressing pin defining an end facing said other one of said brake plates;

said end of said pressing pin being inserted into said substantially conically shaped cover;

a ball of said ball-type connection being centrally supported at said one of said brake plates; and said cover covering and centering said other one of said brake plates which loosely bears upon said one of said brake plates.

12. The warp creel as defined in claim 8, further including:

displaceable set rings each of which is operatively associated with a related one of said first compression spring and said second compression spring of said at least one adjustable tensioning device; and each said first compression spring and each said second compression spring being individually adjustable by means of the displaceable set ring operatively associated therewith.

13. The warp creel as defined in claim 8, wherein:

each one of said first compression spring and of said second compression spring possesses a related spring characteristic; and said spring characteristics of said first compression spring and of said second compression spring being selected such that a relatively large displacement of said control plate results in a small change in the pressing force generated by said first compression spring and said second compression spring.

14. The warp creel as defined in claim 8, further including:

said at least one pair of brake plates constitutes a predetermined number of pairs of brake plates;

said at least one adjustable tensioning device constitutes a predetermined number of adjustable tensioning devices, each of which is operatively associated with a related one of said predetermined number of pairs of brake plates;

said displaceable control plate being operatively connected to said predetermined number of adjustable tensioning devices by means of the gripping sleeves thereof; and said control plate being displaceable and conjointly therewith said gripping sleeves being displaceable relative to the pressing pins of said predetermined number of adjustable tensioning devices such that said difference of said spring forces is continuously adjustable between said range of negative values and said range of positive values through said zero value of such difference at all of said predetermined of adjustable tensioning devices with which said control plate is operatively connected.

* * * * *